US005993266A

United States Patent [19]

Mayer et al.

[11] Patent Number: 5,993,266

[45] Date of Patent: Nov. 30, 1999

[54] KEYING SYSTEM FOR ELECTRICAL CONNECTOR

[75] Inventors: Lori A. Mayer, Harrisburg; Lawrence S. Oh, Myerstown; Steven L. Flickinger, Hummelstown, all of Pa.

[73] Assignee: The Whitaker Corporation, Wilmington, Del.

[21] Appl. No.: 08/731,910

[22] Filed: Oct. 22, 1996

Related U.S. Application Data

[60] Provisional application No. 60/008,188, Oct. 31, 1995.

[51] Int. Cl.[6] ..... H01R 13/64

[52] U.S. Cl. ..... 439/680; 439/294

[58] Field of Search ..... 439/680, 681, 439/677, 318, 294, 314, 315, 317, 678, 679, 292, 293

[56] References Cited

U.S. PATENT DOCUMENTS

| | | | |
|---|---|---|---|
| 1,255,264 | 2/1918 | Wright | 439/294 |
| 2,591,437 | 4/1952 | Jun | 439/294 |
| 2,690,542 | 9/1954 | Pearce et al. | 439/314 |
| 3,129,993 | 4/1964 | Ross | 339/49 |
| 3,146,054 | 8/1964 | Shearer et al. | 339/113 |
| 4,045,107 | 8/1977 | Sutherland | 439/314 |
| 4,060,303 | 11/1977 | Wilczynski | 339/147 R |
| 4,361,374 | 11/1982 | Marmillion et al. | 439/314 |
| 4,737,119 | 4/1988 | Stieler | 439/318 |
| 5,007,862 | 4/1991 | Defibaugh et al. | 439/607 |

OTHER PUBLICATIONS

International Search Report, PCT/US96/16877.

*Primary Examiner*—P. Austin Bradley
*Assistant Examiner*—Tho D. Ta

[57] ABSTRACT

A keying system for an electrical connector (10, 16) is disclosed. Keying members (160, 234) are provided in mating pairs so that one is assembled to the cable connector (10) and the other is assembled to the mating panel connector (16). Each of the keying members (160,234) is assembled by inserting it into the open end of the connector so that lugs (186,236) on the dielectric insert (44,218) within the connector enter camming slots (178) in the keying member (160,234) which is then twisted to lock it in place. The keying members can be easily and conveniently assembled and disassembled in the field by the end user.

8 Claims, 7 Drawing Sheets

KEYING SYSTEM FOR ELECTRICAL CONNECTOR

This application claims the benefit of U.S. Provisional Application No. 60/008,188, Filed Oct. 31, 1995.

RELATED APPLICATION

This invention is directed to a keying system for cylindrical electrical connectors to ensure proper mating of the respective plug and receptacle members thereof.

BACKGROUND OF THE INVENTION

Connectors that are terminated to the ends of electrical cables and mate with mating connectors that are located on fixed panels of electrical equipment are usually keyed so that a cable connector cannot be inadvertently mated to the wrong panel connector. This is especially important when there are several cable connectors mated to somewhat closely adjacent panel connectors, all of which are similar in size and appearance and where the cable connectors must be frequently removed for cleaning or other reasons, such as when interconnecting to other equipment. Since there are a limited number of unique keying arrangements possible, occasionally two panel connectors having the same keying arrangement will be installed in relatively close proximity on the same panel. A problem therefore exists in that there is a likelihood of an inadvertent mismating of these two connectors.

SUMMARY OF THE INVENTION

It is the object of this invention to provide a connector keying system that can be easily installed by the end user in the field and that can be easily changed when a mismating problem is identified. An electrical connector is provided for terminating to electrical conductors and interconnecting to a mating connector in a sanitary environment. The electrical connector and mating electrical connector, each have a cylindrically shaped body and include a keying system for limiting the mated engagement of the connector to a particular mating connector. The keying system includes a cylindrically shaped keying member releasably secured to the connector and having a keying portion extending outwardly therefrom for interacting with a mating keying portion of the mating connector to limit engagement to only a selected mating connector.

DESCRIPTION OF THE FIGURES

The invention will now be described by way of example with reference to the accompanying drawings of which.

DESCRIPTION OF THE PREFERRED EMBODIMENT

Figures 1, 2:
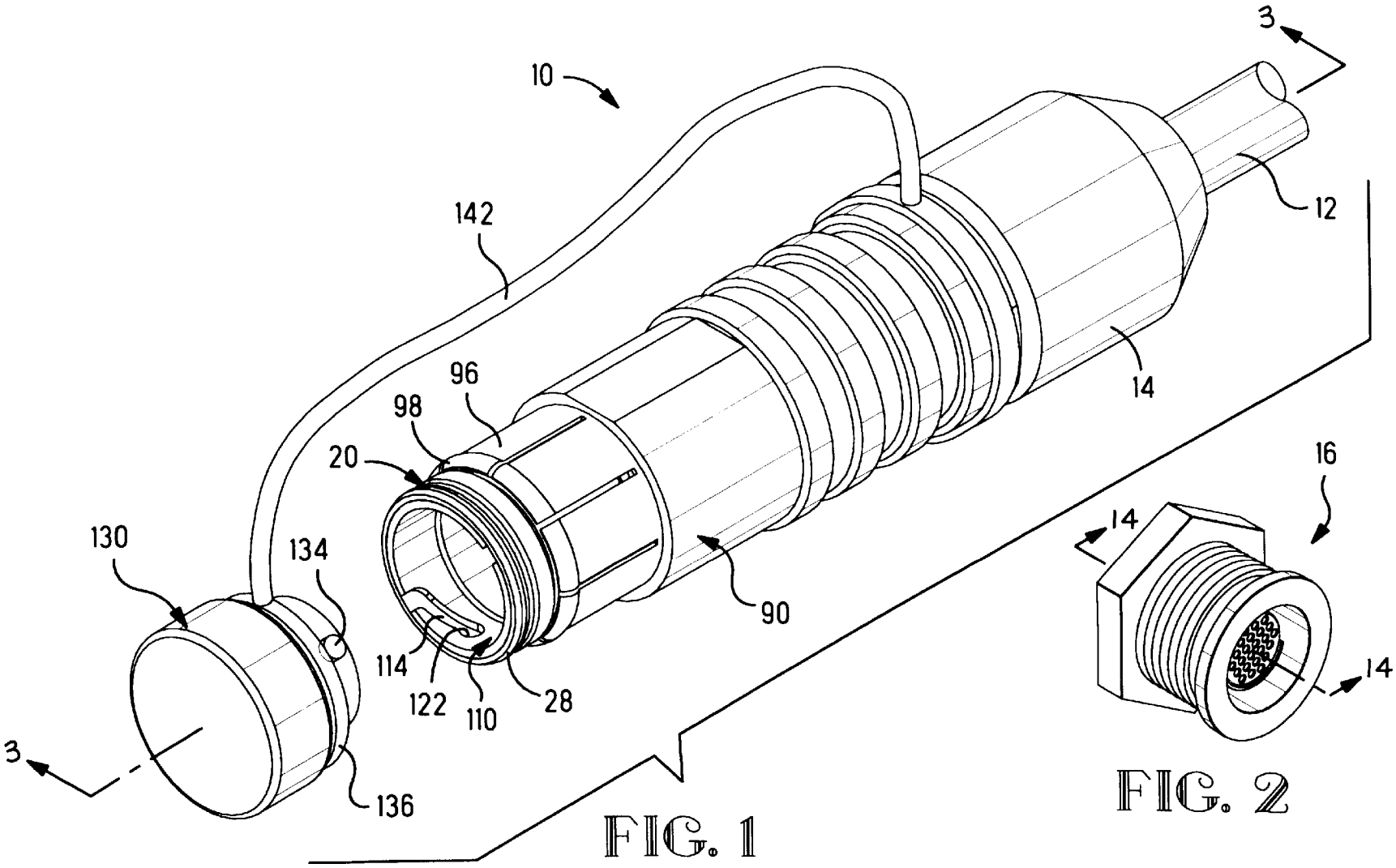
FIG. 1 is an isometric view of an electrical connector incorporating the teachings of the present invention.
FIG. 2 is an isometric view of a panel mountable mating connector for the electrical connector shown in FIG. 1.
Figure 3:
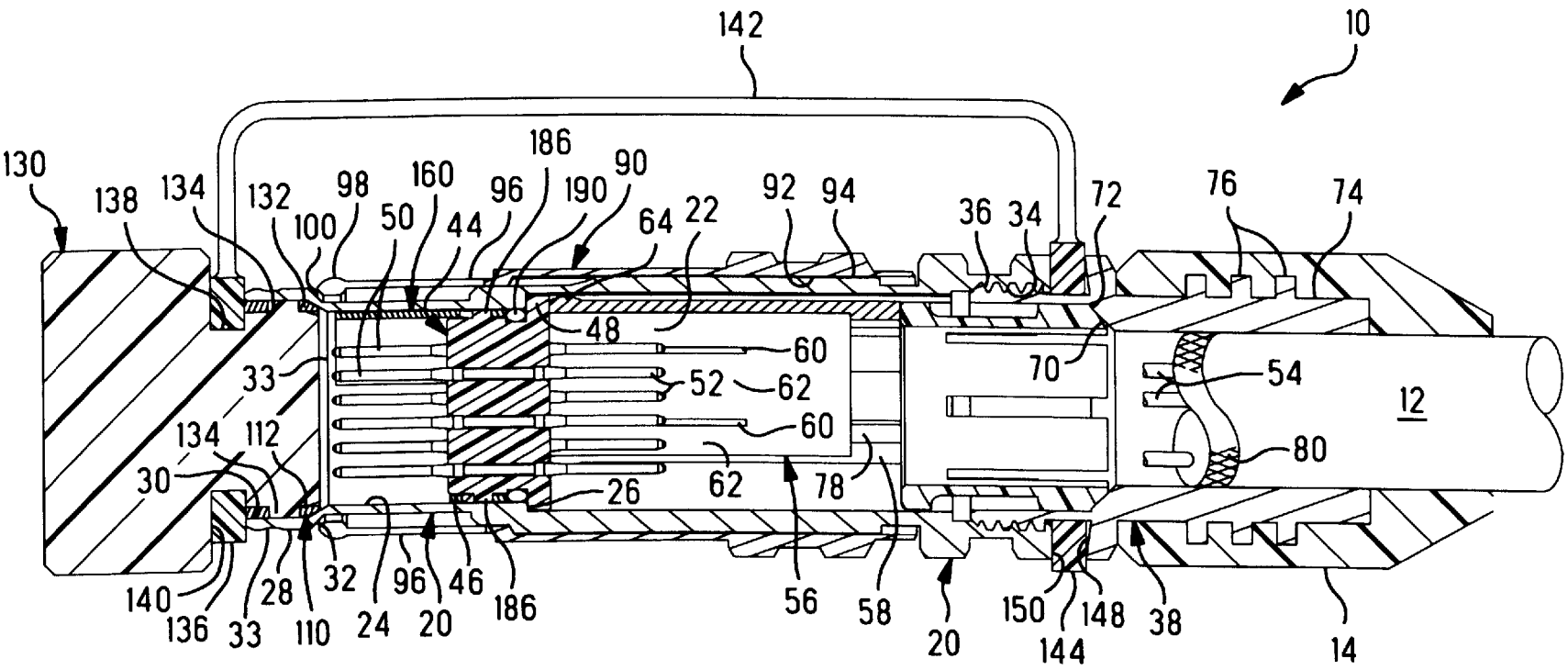
FIG. 3 is a cross-sectional view taken along the lines 3—3 in FIG. 1.
Figure 4:
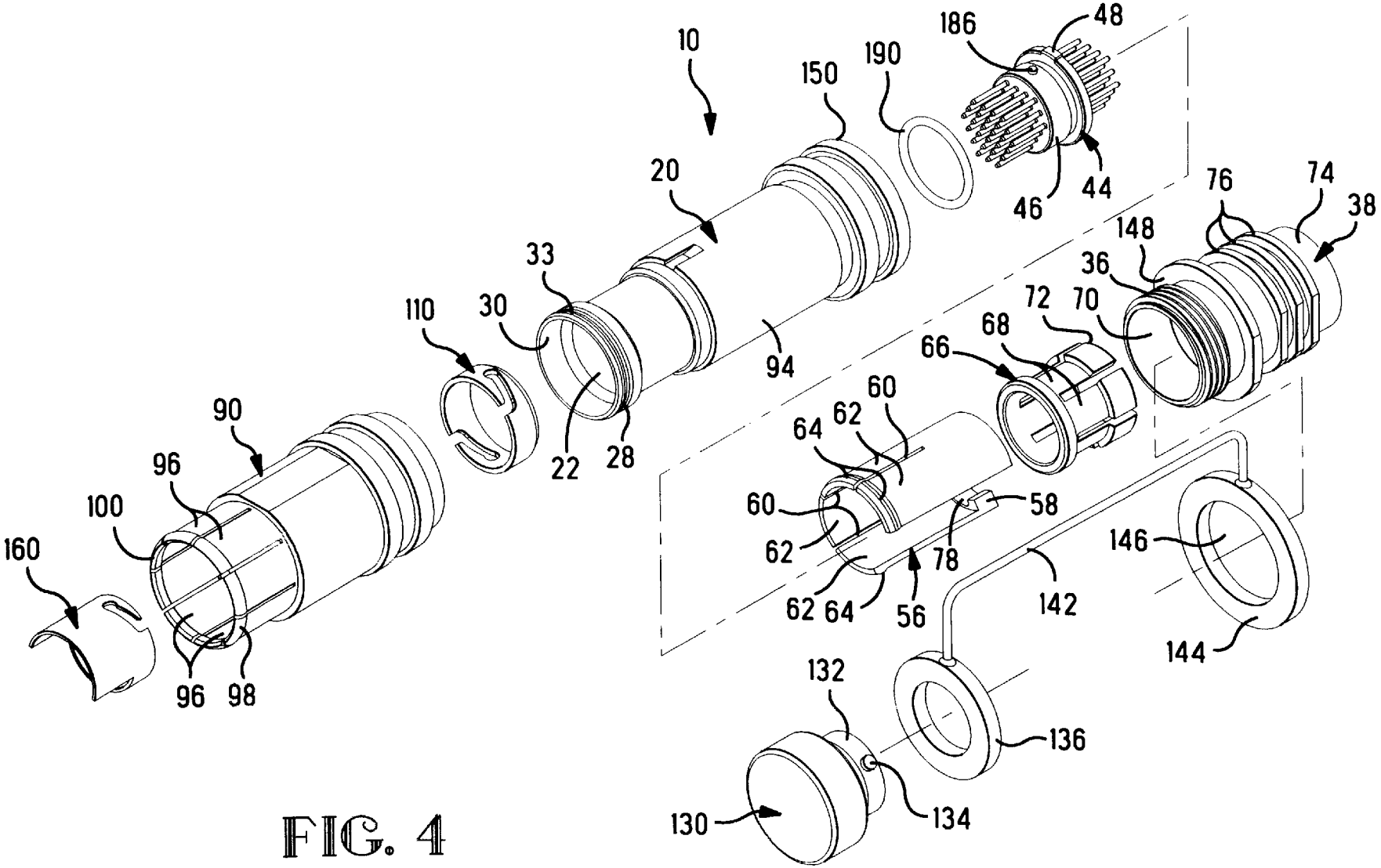
FIG. 4 is an exploded parts view of the connector shown in FIG. 1.

There is shown in FIG. 1 an electrical connector 10 terminated to an electrical cable 12 that is attached to a shank of the connector by means of an overmolded strain relief 14. The electrical connector 10 is arranged to mate with a mating connector 16, shown in FIG. 2, that will be described below. The electrical connector 10, as best seen in FIGS. 1, 3, and 4, includes a cylindrically shaped inner shell 20 having an interior 22, a reduced inside diameter 24 forming a shoulder 26, and a flared end 28 having an inside diameter 30. The flared end 28 forms an angled camming surface 32 for a purpose that will be explained below. Additionally, the outer diameter of the flared end includes an annular depression 33, the purpose of which will be explained below. The opposite end of the inner shell 20 includes an inside threaded diameter 34 for receiving a threaded end 36 of a back nut 38. A dielectric insert 44 having an outside diameter 46 and an outwardly extending flange 48 is disposed within the interior 22 with the flange against the shoulder 26, as best seen in FIG. 3. A plurality of electrical contacts 50 extend outwardly from the dielectric insert 44 toward the flared end 28 and include tails 52 extending in the opposite direction. The cable 12 includes a plurality of conductors 54 that extend into the interior 22, each conductor being interconnected to a respective tail 52 in the usual manner. A C-shaped spacer member 56 includes an inwardly turned flange 58 at one end thereof and three spaced slots 60 formed through the wall and extending from the other end thereof toward the flange 58, as best seen in FIG. 4. The space member 56 is arranged within the interior 22 so that the ends of the arms 62 hold the flange 48 against the shoulder 26. The slots 60 form four resilient arms 62 that can elastically deflect a small amount. The ends of the arms 62 include radiused portions 64 that extend radially outward forming a portion of an outside diameter that is larger than the inside diameter of the interior 22 so that the radiused portions 64 are held tightly against the inner diameter of the inner shell 20 by the resilient arms, as best seen in FIG. 3. A split collet 66 having several cantilevered segments 68 is arranged in abutting engagement with the flange 58 of the spacer member 56 with the segments 68 extending away therefrom. The back nut 38 includes a beveled interior surface 70 that engages outer edges 72 of the cantelevered segments 68 when the back nut is threaded into the threaded diameter 34 thereby urging the split collet 66 into firm engagement with the flange 58 of the spacer 56. As the back nut 38 is tightened, the outer edges 72 of the segments 68 cam radially inwardly to securely clamp onto the outer jacket of the cable 12. As best seen in FIG. 3, the back nut 38 includes a shank 74 having several ribs 76 to which the strain relief 14 is overmolded, in the usual manner. As shown in FIGS. 3 and 4, the flange 58 of the C-shaped spacer member 56 includes a surface 78 for receiving the end of shielding 80, which is soldered in place to effect an electrical ground. The radiused portions 64 of the arms 62 provide good contact between the flange 58 and the inner shell 20, both of which are electrically conductive, thereby providing grounding continuity between the shield 80 and inner shell 20. An outer shell 90 includes an inside diameter 92 that is a loose slip fit with an outside diameter 94 of the inner sleeve 20, as best seen in FIG. 3, so that the outer shell is free to slide somewhat toward and away from the flared end 28. Several annularly disposed arm segments 96 extend from the outer shell 90 toward the flared end 28. As shown in FIG. 3, each arm segment 96 terminates in a nub having an outer arcuate surface 98 and an inner beveled surface 100 facing the angled surface 28, the purpose of which will be explained below.

Figure 5:
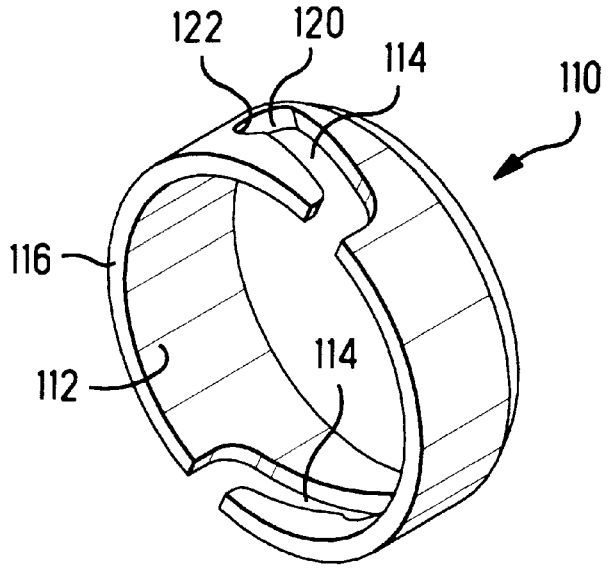
FIG. 5 is an isometric view of a locking ring in the connector shown in FIG. 1.
Figure 6:
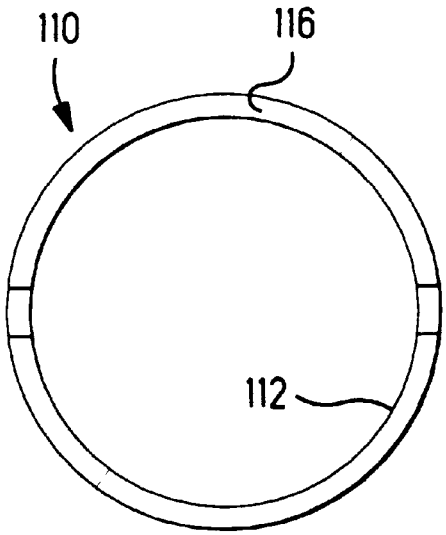
FIGS. 6 and 7 are end and side views, respectively, of the locking ring shown in FIG. 5.
Figure 7:
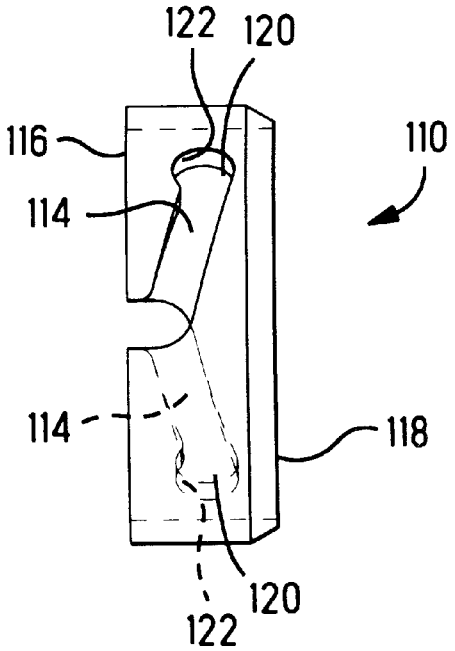
Figure 8:
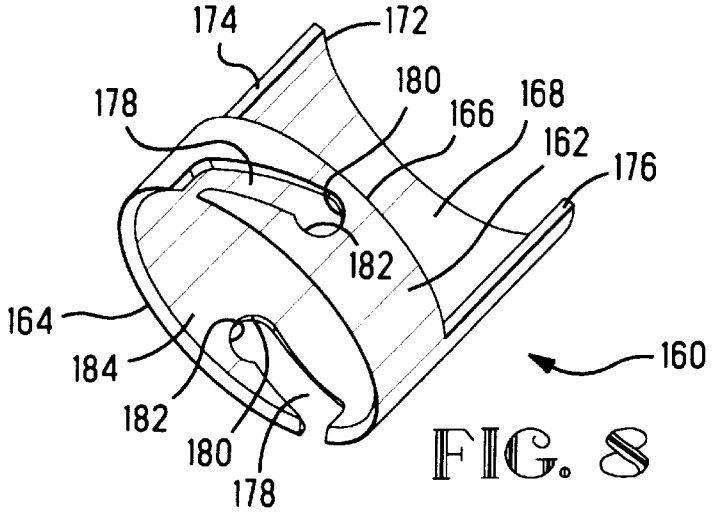
FIG. 8 is an isometric view of a keying member for the connector shown in FIG. 1.

A locking ring 110, as best seen in FIGS. 1, 3, and 4, is disposed in the inside diameter 30 of the flared end 28 and is a press fit therein. As best seen in FIGS. 5, 6, and 7, the locking ring 110 includes an inside diameter 112 that is equal to or greater than the reduced diameter 24 of the inner shell 20. A pair of locking slots 114 are formed in the side of the locking ring diametrically opposite each other. Each slot intersects a first end 116 of the locking ring, then extends on a shallow angle toward a second end 118 and terminates in a radius 120 that extends slightly back toward the first end 116 to form a detent 122. The second end 118 is beveled to conform to the flared portion of the flared end 28 opposite the camming surface 32, as best seen in FIG. 3.

A protective cap 130 is arranged to seal the end of the connector 10 when the connector is submerged in a cleaning solution for sterilization. The protective cap 130 including a reduced diameter 132 that is sized to be received within the inside diameter 112 of the locking ring 110. A pair of oppositely disposed lugs 134 extend outwardly from the reduced diameter 132 and are sized to be received within the locking slots 114 so that when the reduced diameter 132 is inserted into the diameter 112, the lugs enter the locking slots. As the protective cap 130 is twisted in a counterclockwise direction the lugs 134 follow the angled locking slots and enter the detents 122 thereby holding the protective cap in tight engagement with the end of the connector 10. A sealing ring 136 of suitable gasket material is disposed within an annular slot 138 undercut in the reduced diameter 132. The undercut forms a shoulder 140 which presses the sealing ring 136 into sealing engagement with the flared end 28 so that cleaning solution cannot penetrate into the interior 22 of the inner shell 20 during submersion in the cleaning solution for sterilization. The protective cap 130 is held captive to the connector 10 by means of a flexible lanyard 142 which is attached at one end to the sealing ring 136 and at the other end to a retaining and sealing ring 144 having a hole 146 that closely fits over the threaded end 36 of the back nut 38. The retaining and sealing ring 144 is wedged between a shoulder 148 of the back nut 38 and an end 150 of the inner shell 20 in sealing engagement therewith, as best seen in FIG. 3.

The sealing ring 136, lanyard 142, and retaining and sealing ring 144 may be of unitary construction or of separate parts suitably attached together to form a tether. These parts may be manufactured by molding, stamping out of sheet material, or other suitable process.

Figure 11:
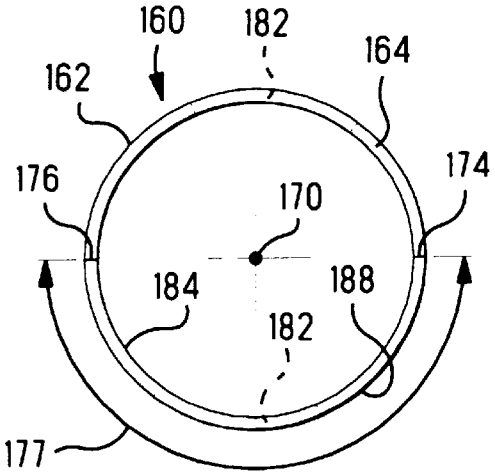
FIGS. 9, 10, and 11 are plan, side, and end views of the keying member shown in FIG. 8.
Figure 9:
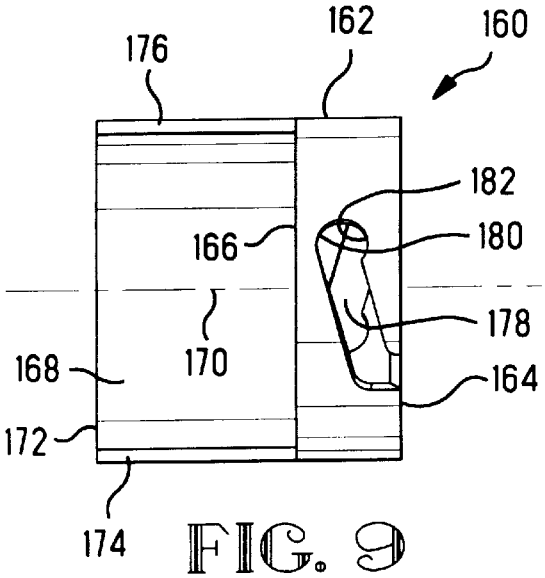
Figure 11A:
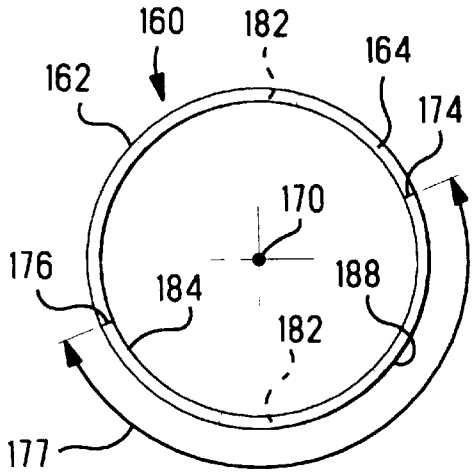
Figure 10:
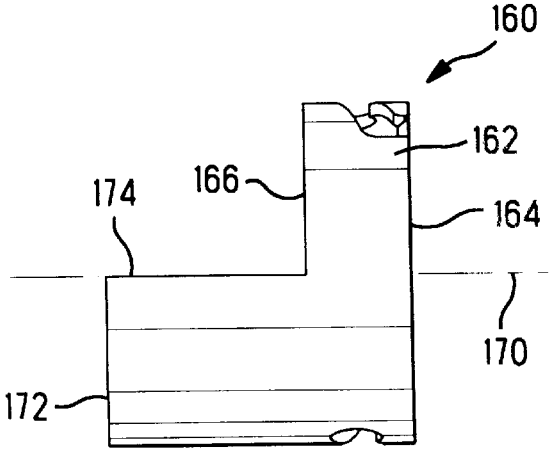
Figures 12, 13:
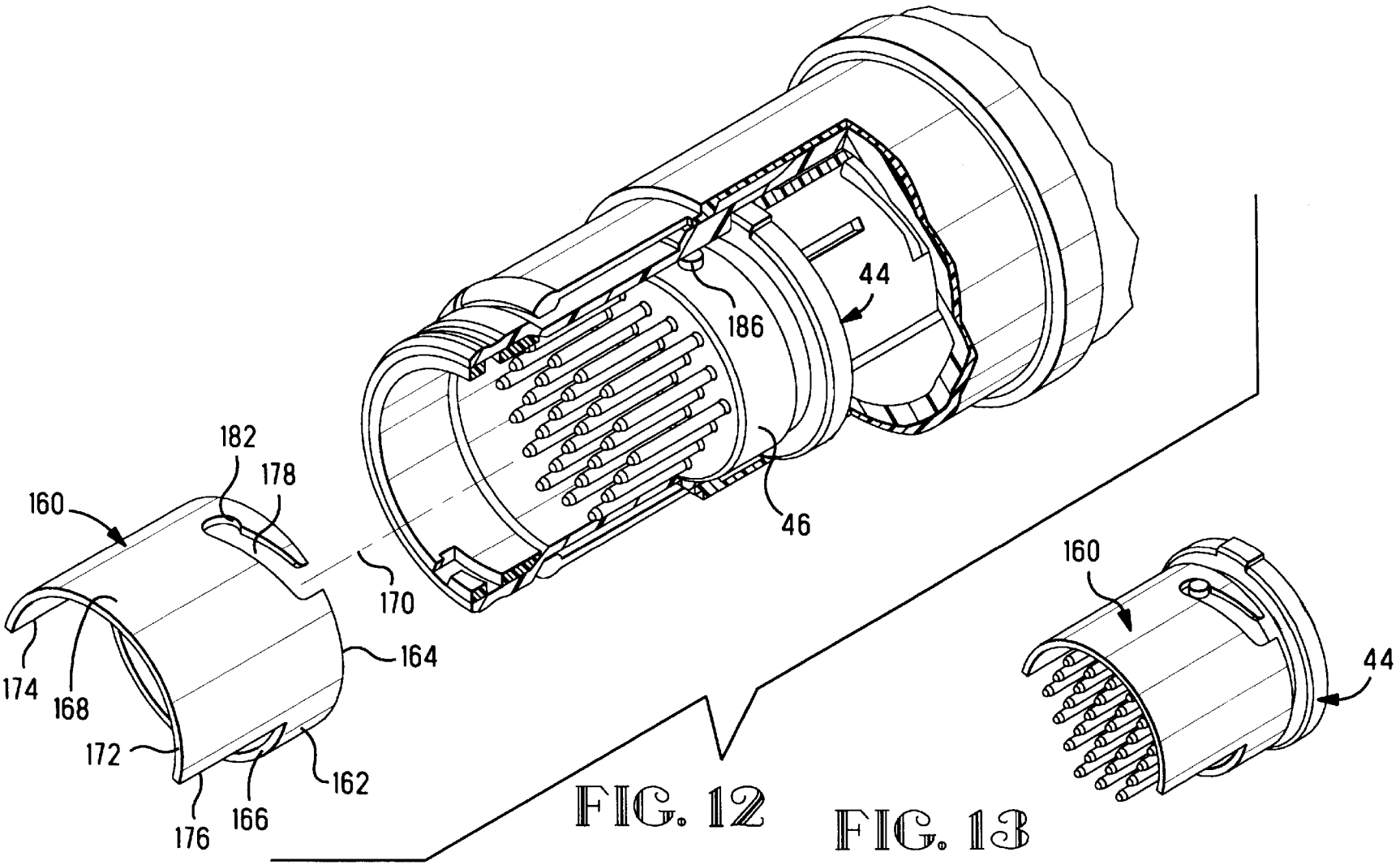
FIG. 12 is an isometric cutaway view of a portion of the connector shown in FIG. 1.
FIG. 13 is an isometric view showing the keying member assembled to the insert.

As shown in FIGS. 3 and 4, a first keying member 160 is disposed within the reduced diameter 24 partially encircling the contacts 50. As best seen in FIGS. 8 through 11, the first keying member 160 includes a ring shaped base 162 having a first end 164 and a second end 166. A partially cylindrically shaped portion or keying element 168 extends from the second end 166 along a longitudinal axis 170*e* terminating in an end 172 and two opposite edges 174 and 176. As shown in FIG. 11, the keying element 168, in the present example, curves through an angle 177 that is slightly less than 180 degrees from the edge 174 to the edge 176, however, it may curve through a smaller or larger angle. The reason that the angle is slightly less than 180 degrees, in the present example, is to provide clearance between the opposing edges 174 and 176 when the two connectors 10 and 16 are mated, as will be explained below. The ring shaped base 162 includes a pair of locking slots 178 that are formed in the side of the base diametrically opposite each other. Each slot intersects the first end 164 of the base, then extends on a shallow angle toward the second end 166 and terminates in a radius 180 that extends slightly back toward the first end 164 to form a detent 182. This detent 182 is important because it angularly positions the keying member 160 within the connector 10. Further, as will be explained below, the position of the keying element 168 may be angularly displaced with respect to the detents 182. For example, as shown in FIG. 12A, the keying element is angularly displaced counterclockwise about 15 degrees while the detents remain in the position shown in FIG. 11. It will be understood that such angular displacement may be of any suitable amount. The base 162 has an inside diameter 184 that is sized to be a loose slip fit with the outside diameter 46 of the dielectric insert 44, and has an outside diameter 188 that is sized to easily slip into the reduced diameter 24. A pair of lugs 186 extend outwardly from opposite sides of the diameter 46 and are sized to be received in the locking slots 178. As best seen in FIGS. 12 and 13, the first keying member 160 is assembled to the connector 10 by aligning its axis 170 with the longitudinal axis of the connector and moving it into the opening of the inside diameter 112 and into the interior of the reduced diameter 24 until the base slips over the end of the outside diameter 46 of the insert 44 and the lugs 186 engage the locking slots 178. The first keying member 160 is then rotated about its axis 170 in a clockwise direction so that the lugs 186 follow the angled locking slots 178 and enter the detents 182 thereby securing the first keying member in tight engagement with the dielectric insert 44. A resilient ring 190 of suitable material is arranged between the flange 48 and the first end 164 of the base 162. The ring 190 is resilient enough to compress as the lugs 186 follow the angled locking slots and then to decompress a lesser amount as the lugs enter the detents 182 so that the ring remains compressed enough to hold the lugs within the detents This assembly of the first keying member 160 to the connector 10 is intended to be accomplished in the field by the end user of the connector. Further, the first keying member 160 may be removed from the connector 10 and a different first keying member installed, as will be explained below.

Figures 14, 15:
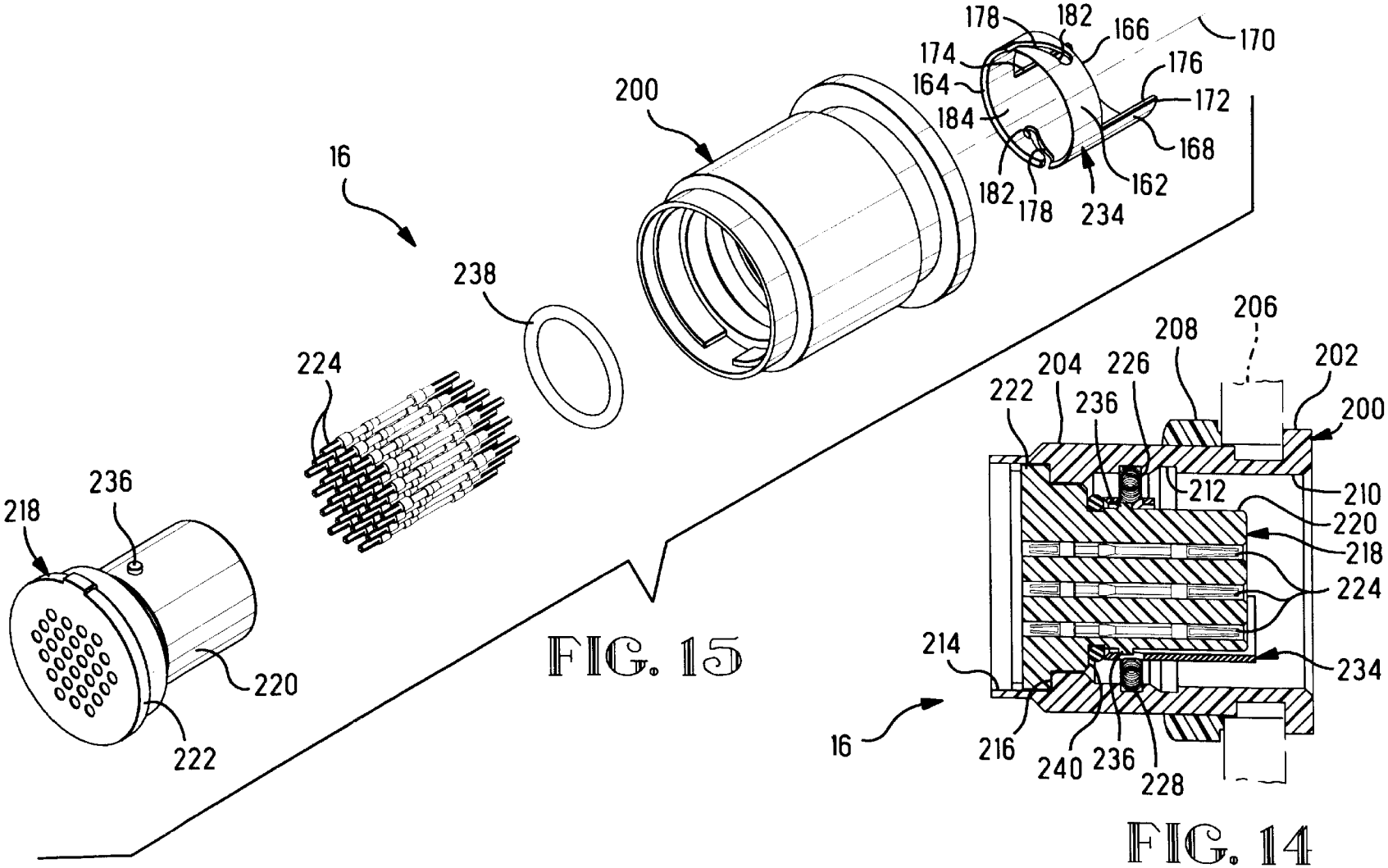
FIG. 14 is a cross-sectional view taken along the lines 14—14 of FIG. 2.
FIG. 15 is an exploded parts view of the connector shown in FIGS. 2 and 14.

As best seen in FIGS. 14 and 15, the mating connector 16 that mates with the connector 10 includes a housing 200 having a flange 202, a threaded diameter 204 that extends through an opening in a panel 206 shown in phantom lines in FIG. 14, and a nut 208 that is threaded onto the threaded diameter and tightened against the panel to secure the connector 16 to the panel. The housing 200 included in inside diameter 210 that is slightly smaller than the outer diameter of the outer shell 90 so that when the end of the connector 10 is inserted into the diameter 210, the arcuate surfaces 98 of the arms 96 are resiliently deflected inwardly a slight amount. A groove 212 is formed in the surface of the inside diameter 210 so that when the connector 10 is fully mated with the mating connector 16 the arms 96 resiliently deflect outwardly so that the arcuate surfaces 98 enter into the groove, for a purpose that will be explained. The end of the connector 16 opposite the flange 202 includes a counterbore 214 that forms a shoulder 216. A dielectric insert 218 having a diameter 220 and a flange 222 is arranged within the housing 200 so that the flange 222 is in the counterbore 214 and against the shoulder 216, as shown in FIG. 14. The insert 218 is staked in place within the housing 200 in the usual manner. A number of receptacle contacts 224 are retained in openings in the dielectric insert 218 and arranged for mating with the contacts 50 of the connector 10 when the two connectors are mated. The inside diameter 210 of the housing 200 includes an annular groove 226 adjacent the groove 212 that contains an EMI shielding spring gasket 228. When the connector 10 is mated to the connector 16, the spring gasket 228 is slightly expanded by the outer surface of the flared end 28 until the annular depression 33 is aligned with the spring gasket, which then elastically contracts to enter the depression thereby forming a latch that holds the connectors in mated engagement. Additionally, the spring gasket 228 provides grounding continuity between the shield 80 of the cable 12 and the housing 200.

A second keying member 234 which mates with and is similar in all respects to the first keying member 160 is disposed within the housing 200 so that its ring shaped base 162 is encircling the diameter 220 of the insert 218. A pair of lugs 236 extend outwardly from opposite sides of the diameter 220 and are sized to be received in the locking slots 178 of the second keying member. The second keying member 234 is assembled to the connector 16 by aligning its axis 170 with the longitudinal axis of the connector and moving it into the opening of the inside diameter 210 until the base slips over the end of the outside diameter 220 of the insert 218 and the lugs 236 engage the locking slots 178. The second keying member 234 is then rotated about its axis 170 in a clockwise direction so that the lugs 236 follow the angled locking slots 178 and enter the detents 182 thereby securing the second keying member in tight engagement with the dielectric insert 218. A resilient ring 238 of suitable material is arranged between a shoulder 240 of the insert 218 and the first end 164 of the second keying member 234. The ring 238, similar to the ring 190, is resilient enough to compress as the lugs 236 follow the angled locking slots 178 and then to decompress a lesser amount as the lugs enter the detents 182 so that the ring remains compressed enough to hold the lugs within the detents. As with the first keying member 160, the assembly of the second keying member 234 to the connector 16 is intended to be accomplished in the field by the end user of the connector.

The first and second keying members 160 and 234 may be removed from the connectors 10 and 16, without taking the connectors apart, and a different matched pair of first and second keying members installed when, for example, it is desired to change the keying arrangement of adjacent connectors on an equipment panel. It will be understood that the keying elements 168 of the first and second keying members 160 and 234 may be positioned at different angular positions on their respective ring shaped base 162 with respect to the detents 182 thereby providing several different matched pairs having unique keying positions. The requirement is that each matched pair of first and second keying members 160 and 234 have keying elements 168 that are angularly positioned with respect to their detents 182 so that they complement each other, that is, they will allow the connectors to mate, however, will not allow mating if the first and second keying members are not members of the same matched pair with complementary positioned keying elements 168. Additionally, each keying element 168 may curve from the edge 174 to the edge 176 through an angle that is substantially more or less than 180 degrees. However, when one of the keying elements curves substantially less than 180 degrees, the other keying element of the pair must curve a greater amount so that the two keying elements total slightly less than 360 degrees. The reason that the total is less than 360 degrees is to provide clearance between the opposing edges 174 and 176 of the two mated keying elements. It will be understood that any combination of angular position of the keying element 168 and the extent of curvature from the edge 174 to the edge 176 may be used to define a unique keying position for a matched pair of keying members 160 and 234.

In operation, the connector 10 is mated to the connector 16 by inserting the flared end 28 into the opening of the inside diameter 210 so that the orientation key is aligned with the orientation keyway. Insertion continues as the keying elements 168 of the first and second keying members 160 and 234 pass each other, allowing the contacts 50 to engage the receptacle contacts 234. As insertion continues the outer surface of the flared end 28 engages and latches with the EMI shielding spring gasket 228 and the arcuate surfaces 98 are urged into the groove 212 by the resilient deflection of the arms 96. At this point the connector 10 is fully mated to the connector 16. In the event that the cable 12 is inadvertently pulled, the inner shell 20 will move away from the connector 16, in the direction of the pulling force, and the camming surface 32 will engage the beveled surfaces 100 thereby resiliently deflecting the arms 96 outwardly so that the arcuate surfaces 98 lock into the groove 212 preventing the two connectors 10 and 16 from disengaging. When it is desired to disengage the two connectors, the outer shell 90 is manually gripped and urged away from the connector 16 so that the arcuate surfaces 98 cam inwardly and out of the groove 212, resiliently deflecting the arms 96. The connector 10 is then moved out of engagement with the connector 16.

An important advantage of the present invention is that the keying members are installed in the connector and mating connector in the field by the end user. This permits the easy establishment of unique keying for a group of adjacent connectors such as might be found on an equipment panel thereby preventing mismating of these connectors.

What is claimed:

1. An electrical connector for interconnecting with a mating electrical connector, each of said connector and mating connector having a cylindrically shaped body with an interior cavity therein, and a dielectric insert in said interior cavity comprising:

a keying system for limiting mated engagement of said connector to a particular said mating connector, the keying system comprising at least one cylindrically shaped keying member releasably secured to said connector inside said interior cavity and having a keying portion extending outwardly therefrom for interacting with a mating keying portion of the mating connector to effect said limiting of mated engagement, said keying member having a recess and said connector including a projection, wherein said projection and said recess are arranged to be engageable with each other, said recess being adjacent an edge of said keying member and including an opening that intersects said edge for receiving said projection when said keying member is inserted into said connector.

2. The electrical connector according to claim 1 wherein said projection extends from a surface of the dielectric insert.

3. The electrical connector according to claim 1 wherein said recess includes a detent, said projection being positioned within said detent when said keying member is releasably secured to said connector.

4. The electrical connector according to claim 1 wherein said recess includes a camming surface that is angled with respect to said edge, intersecting said opening, and arranged so that said keying member is secured to said connector by said projection camming against said camming surface.

5. The electrical connector according to claim 4 wherein said connector includes an annular flange and said edge of said keying member is in engagement with said flange when said keying member is in locking engagement with said connector.

6. The electrical connector according to claim 5 including a semi-rigid member between said edge of said keying member and said flange.

7. The electrical connector according to claim 1 wherein said keying portion includes a first edge and a second edge and curves through a first angle from said first edge to said second edge.

8. The electrical connector according to claim 7 wherein said mating keying portion includes a third edge and a fourth edge and curves through a second angle from said third edge to said fourth edge, and wherein the sum of said first and second angles is slightly less than 360 degrees.

* * * * *